US006854842B2

(12) United States Patent
Martin et al.

(10) Patent No.: US 6,854,842 B2
(45) Date of Patent: Feb. 15, 2005

(54) INK JET PRINTER HAVING A DUAL FUNCTION AIR COOLING AND DRYING SYSTEM

(75) Inventors: Andrew T. Martin, Webster, NY (US); Marc J. Krolczyk, Rochester, NY (US); Keith S. Karn, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 78 days.

(21) Appl. No.: 10/314,820

(22) Filed: Dec. 9, 2002

(65) Prior Publication Data

US 2004/0109054 A1 Jun. 10, 2004

(51) Int. Cl.[7] ..... B41J 2/01
(52) U.S. Cl. ..... 347/102
(58) Field of Search ..... 347/17–19, 100, 347/102

(56) References Cited

U.S. PATENT DOCUMENTS 4,638,337 A 1/1987 Torpey et al. ..... 346/140 R
5,287,123 A * 2/1994 Medin et al. ..... 347/17
5,461,408 A * 10/1995 Giles et al. ..... 347/102
5,831,655 A * 11/1998 Asawa et al. ..... 347/102
6,196,672 B1 * 3/2001 Ito et al. ..... 347/88
6,209,999 B1 * 4/2001 Wen et al. ..... 347/104

* cited by examiner

*Primary Examiner*—Thinh Nguyen
*Assistant Examiner*—Julian D. Huffman
(74) *Attorney, Agent, or Firm*—Tallam Nguti

(57) ABSTRACT

An ink jet printer including (a) a frame defining a sheet moving path and a printing zone; (b) copy sheet moving means for moving a supplied copy sheet along the sheet moving path and through the printing zone; (c) a printhead assembly mounted to the frame within the printing zone for printing liquid ink images onto one side of the supplied copy sheet; (d) electronic components including a controller connected to the sheet moving means and to the printhead assembly for controlling operations thereof; and (e) a dual function air cooling and drying system mounted to the frame for moving air to cool the electronic components and to then dry the liquid ink images on the one side of the supplied copy sheet, the dual function air cooling and drying system including conditioning means positioned between the electronic components and the liquid ink images on the supplied copy sheet for selectively varying a condition of air being moved from the electronic components to the liquid images.

18 Claims, 2 Drawing Sheets

INK JET PRINTER HAVING A DUAL FUNCTION AIR COOLING AND DRYING SYSTEM

BACKGROUND OF THE INVENTION

The present invention relates generally to ink jet printers, and more particularly, to such a printer having a dual function air cooling and drying system.

Ink jet printers include several types including the so-called "drop-on-demand" type that has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice or nozzle until the current pulse has ceased and the bubble begins to collapse. At that stage, the ink within the channel retracts and separates from the bulging ink which forms a droplet moving in a direction away from the channel and towards a recording medium. The channel is then refilled by capillary action, drawing ink from a supply container.

One particular example of a type of thermal ink jet printer is described in U.S. Pat. No. 4,638,337. That printer is of the carriage type and has a plurality of printheads, each with its own ink supply cartridge, mounted on a reciprocating carriage. The channel orifices or nozzles in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

Typically, such ink jet printers have electronic components that include a power supply, integrated circuit components, controller chips and the like, most of which become hot from use and may require cooling. Generally, heatsinks and cooling devices are used for such cooling in order to keep the printer printing effectively for long periods.

The amount of information that is printed on sheets, and hence the actual quantity of liquid ink deposited on sheets, varies greatly from sheet to sheet. In addition, there is a general and customer desired trend to have ink jet printers that are capable of printing a greater and greater number of pages or sheets per minute.

Unfortunately, as is well known, liquid ink images printed as such ordinarily include excess moisture (generally water) on the surface of printed sheets that must be removed within a set time period and before the sheets are stacked. If the sheets are stacked before the liquid ink images are dry, image smearing and image offset defects typically occur. Devices that actively remove moisture, specifically water, from the sheet surface are referred to as dryers.

Conventionally, separate or stand alone dryers that are constantly on, and that blow a constant volume of hot air, are used for drying such liquid ink images. Dryers of this type that are used in this manner, are ordinarily costly, would tend to be bulky for faster and faster (pages per minute) printers, and could actually damage a liquid image if the volume or velocity of air being blown is too much or too soon for a particular liquid ink image.

SUMMARY OF THE INVENTION

In accordance with the present invention, there is provided an ink jet printer including (a) a frame defining a sheet moving path and a printing zone; (b) copy sheet moving means for moving a supplied copy sheet along the sheet moving path and through the printing zone; (c) a printhead assembly mounted to the frame within the printing zone for printing liquid ink images onto one side of the supplied copy sheet; (d) electronic components including a controller connected to the sheet moving means and to the printhead assembly for controlling operations thereof; and (e) a dual function air cooling and drying system mounted to the frame for moving air to cool the electronic components and to then dry the liquid ink images on the one side of the supplied copy sheet, the dual function air cooling and drying system including conditioning means positioned between the electronic components and the liquid ink images on the supplied copy sheet for selectively varying a condition of air being moved from the electronic components to the liquid images.

BRIEF DESCRIPTION OF THE DRAWINGS

In the detail description of the invention presented below, reference is made to the drawings, in which.

DESCRIPTION OF THE INVENTION

Figure 1:
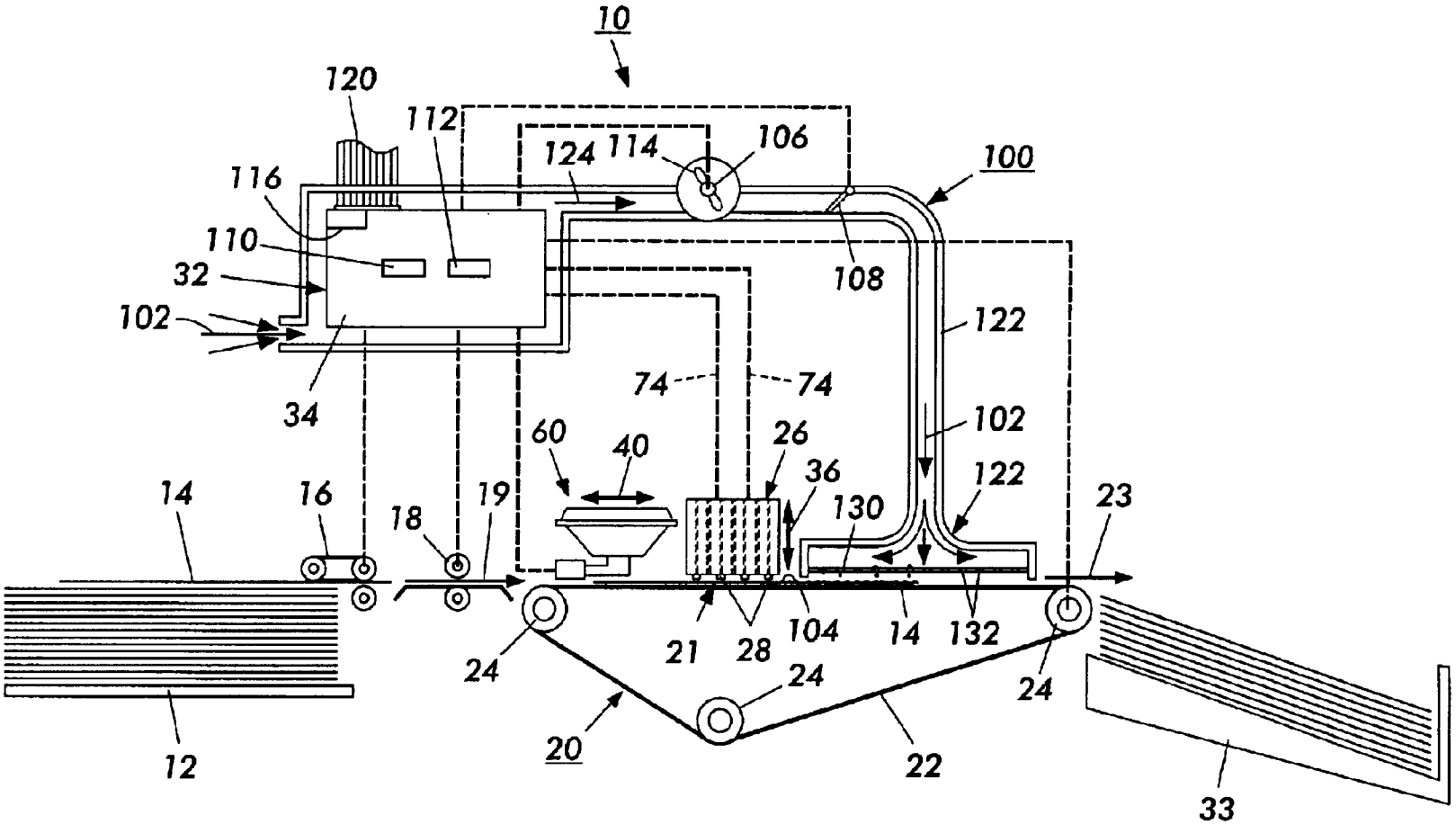
FIG. 1 is a schematic elevational view of a liquid ink jet printer having the dual function air cooling and heating system of the present invention.

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to FIG. 1, there is shown a schematic elevational view of a liquid ink printing machine 10, for instance, an ink jet printer. As shown, the liquid ink machine or ink jet printer 10 includes an input tray 12 containing a stack of copy sheets of paper 14 to be printed upon by the printer 10.

Single sheets of the sheet of paper 14 are removed from the input tray 12 by sheet moving means comprising a pickup device 16, feed rollers 18, and a transport mechanism 20 for moving the sheet 14 along a sheet moving path 19 through the printing zone 21. The transport mechanism 20 moves the sheet by a feed belt or belts 22 driven by one of support rollers 24 beneath a liquid ink printhead assembly 26.

The printhead assembly 26 as is well known, includes a liquid ink supply (not labeled) that is attached for example to the printhead support or coupled to associated printheads through appropriate supply tubing. The printhead assembly 26, for example includes printheads 28 which, for example, can be reciprocating printheads, or partial, or page width array, printheads supported in a printing position by a printhead support (not shown) in a confronting relation with the belt 22.

During printing, the printheads 28 image-wise deposit droplets of liquid ink onto the sheet of paper 14 as the paper is carried by the belt 22 past the printing zone 21 beneath the plurality of printheads 28. As is also well known, each of the printheads 28 includes an array of print nozzles, for instance, staggered or linear arrays, having a length sufficient to image-wise deposit droplets of liquid ink as above, within the printing zone 21. As the sheet of paper 14 is moved through the printing zone 21, the printheads 28 print or record liquid ink images on the sheet of paper 14.

As shown, the ink jet printer 10 includes electronic components 32 including a controller 34 that is connected to the sheet moving means 16, 18, 20 and to the printhead assembly 26 for controlling operations thereof. The controller 34 is preferably a self-contained, dedicated mini-computer having a central processor unit (CPU), electronic storage, and a display or user interface (UI). With the help of sensors and connections (not shown), the controller 34 reads, captures, prepares and manages the flow of data for the image being printed by the printheads 28. In addition, the controller 34 is the main multi-tasking processor for operating and controlling all of the other machine subsystems of the printer 10 including the dual function air system—of the present invention (to be described in detail below).

At the completion of a printing job or when otherwise necessary, such as during a power failure, the printhead assembly 26, is moved away from the belt 22 in the directions of an arrow 36. A vacuum assembly 60 including a molded capping member 52 is moved beneath the printhead assembly 26, in the directions of the arrow 40 for capping the printheads 28 of the printhead assembly 26.

Once the printheads 28 are positioned directly over the vacuum assembly 60, the printhead assembly 26 is moved towards the belt 22 and into sealing engagement with the vacuum assembly 60 for effective priming.

When the printhead assembly 26, has been capped, and fully primed as above, and is again needed for another printing job, it is moved away from the belt 22 and the vacuum assembly 60 is then moved away from the printhead assembly 26 such that the printhead assembly 26 can be repositioned appropriately with respect to the belt 22 for printing on the recording sheets 14.

Figure 2:
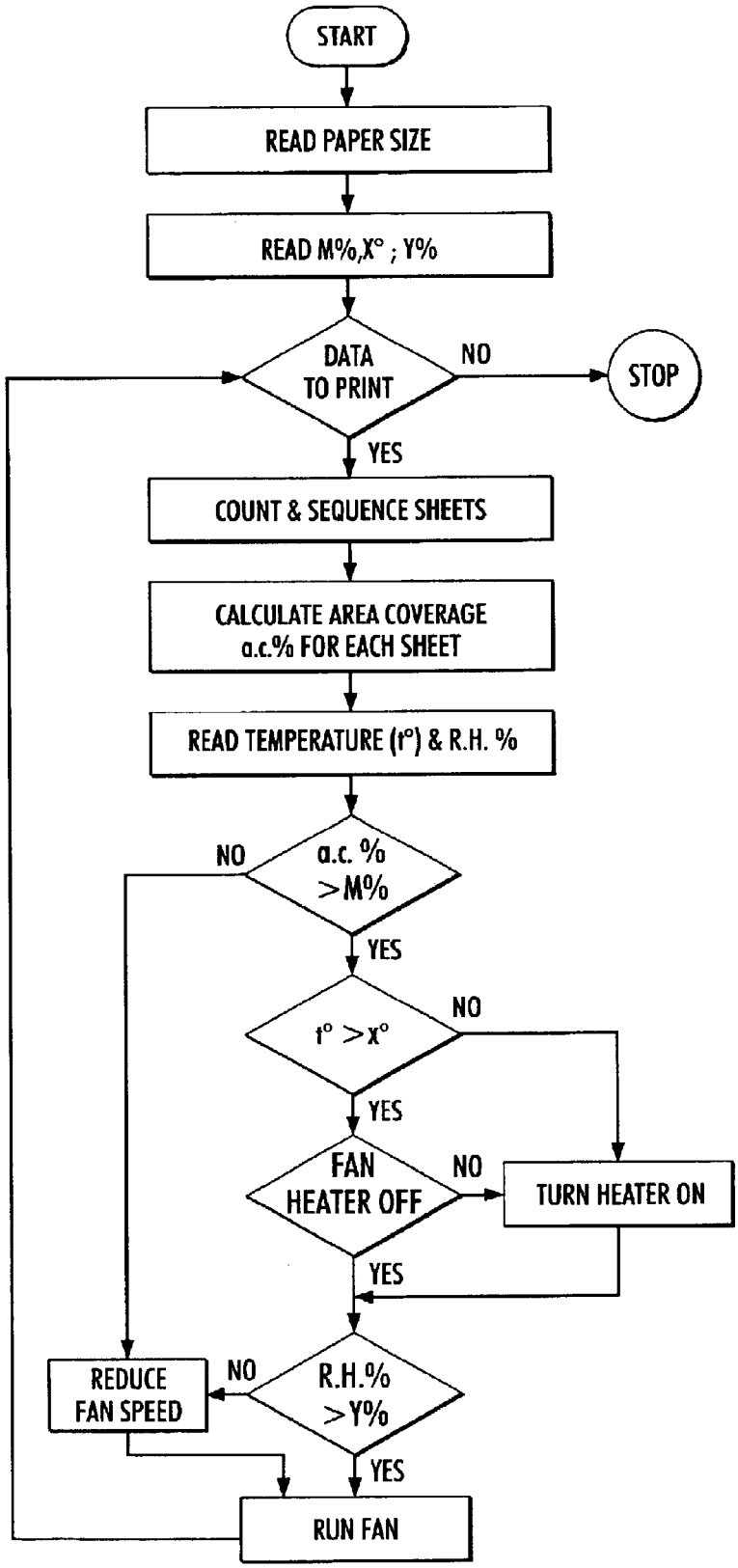
FIG. 2 is a flow chart illustration of the method and control of the dual function air cooling and heating system of the present invention.

Referring now to FIGS. 1–2 and in particular to FIG. 2, the ink jet printer 10 includes (a) means 16, 18, 20 defining a sheet moving path 19 and a printing zone 21; (b) copy sheet moving means 16, 18, 20 for moving a supplied copy sheet 14 along the sheet moving path and through the printing zone; (c) a printhead assembly 26 mounted within the printing zone for printing liquid ink images onto one side of the supplied copy sheet; (d) electronic components 32 including a controller 34 connected to the sheet moving means and to the printhead assembly 26 for controlling operations thereof; and (e) a dual function air cooling and drying system 100 mounted for moving air 102 to cool the electronic components 32 and to then dry the liquid ink images 104 on the one side of the supplied copy sheet 14.

The dual function air cooling and drying system 100 includes air conditioning means such as a separate air heating element 106, and an air volume divider 108, that are positioned between the electronic components 32 and the liquid ink images 104 (on the supplied copy sheet) for selectively varying a condition of air being moved from the electronic components to the liquid images.

In one particular embodiment, the printhead assembly 26 includes at least one thermal ink jet printhead 28 as described above. The electronic components 32 include a temperature sensor 110 for sensing either the temperature of individual electronic components or of the air being moved thereover for cooling. The temperature sensor 110 is used with the controller 34 for controlling the on and off condition of the separate air heating element 106. As shown in FIG. 2, if this sensed temperature is below a certain threshold denoted as t°, the separate heating element will be turned on in order to raise the temperature of the air being used to dry the liquid ink images.

The electronic components also include a relative humidity (RH) sensor 112 for measuring the relative humidity of the air being moved over the electronic components. The dual function air system 100 further includes a variable speed air moving means or fan 114 having a speed that is controlled for example as a function of a result of the relative humidity sensor 112 or of that of the temperature sensor 110.

As also shown in FIG. 2, if the sensed relative humidity is above a certain threshold denoted as y %, the separate heating element will be turned on, and the speed of the air fan 114 will be increased in order to maintain or increase the air's ability for removing moisture from the liquid ink images being dried.

As an aspect of the present invention, the controller 34 includes calculating means 116 for calculating from incoming data 120, liquid ink image area coverage ratio denoted in FIG. 2 as ac % for each image page to be printed. The variable speed of the air fan 114 can also be controlled as a function of a result of the liquid ink area coverage calculating means 116. Again as shown in FIG. 2, if the calculated ac % is above a certain threshold denoted as M %, then the separate heating element 106 will be turned on, and the speed of the air fan 114 will be increased in order to maintain or increase the air's ability for removing the increased amount of moisture expected from such a relatively high ac % of the liquid ink images being dried.

As further shown, the dual function air cooling and drying system 100 also includes an air conduit assembly 122 within which is mounted the variable speed air fan 114 for moving a volume of air across the electronic components 32 and variably onto the liquid ink images 104 on the supplied copy sheet 14. The air conduit assembly 122 includes the selective air volume divider 108 that is movable from a fully closed position to a fully open position for regulating a volume of air flowing onto the liquid ink images on the supplied copy sheet, and that is mounted downstream of the electronic components 32 relative to a direction 124 of air movement.

The air conditioning means 106, 108 are located downstream of the electronic components 32 relative to the direction 124 of air movement for increasing (if necessary) a temperature of air that has been drawn over the electronic components. The air conditioning means also include a non-uniform air discharge nozzle 126 that is mounted over the sheet moving path 19, and immediately downstream of the printing zone 21 relative to a direction 23 of sheet movement.

As shown, the non-uniform air discharge nozzle 126 has a first pattern of narrower and narrower air holes 130 located towards the printhead assembly 26, and a second pattern of larger and larger air holes 132 located farther and farther away downstream of the printhead assembly 26 relative to the direction 23 of sheet movement.

Thus in accordance with the present invention, there i8s also provided in a liquid ink jet printer having electronic components 32 and means including a printhead assembly 26 for printing liquid images 104 on a supplied copy sheet 14, a method of cooling the electronic components and then drying the liquid ink images on one side of the supplied copy sheet.

The method includes (a) receiving data 120 into the electronic components 32 about images to be printed with liquid ink; (b) calculating a liquid ink image coverage ratio for each page of liquid ink images to be printed using means 116; (c) moving air with a fan 114 over the electronic components 32 for discharge onto liquid ink images 104 being printed by the printhead assembly on the supplied copy sheet; and (d) selectively varying a condition of air being moved from the electronic components to the liquid images as a function of a result of calculating a liquid ink image coverage ratio for each page of liquid ink images to be printed.

In accordance with one aspect of this method, a volume of air being moved from the electronic components 32 to the liquid images 104 is selectively varied, for example, by use of an air volume divider 108, as a function of a result of calculating the liquid ink image coverage ratio ac % for each page of liquid ink images to be printed. The same can also be accomplished by varying a quantity and force of air being discharged onto the liquid ink images by using a non-uniform air discharge nozzle 126 having a first pattern of narrower and narrower air holes 130 located towards the printhead assembly 126, and a second pattern of larger and larger air holes 132 located farther and farther away downstream of the printhead assembly relative to the direction 23 of sheet movement.

Another aspect of the method includes sensing a temperature t°, of air that has been moved over the electronic components and selectively turning the separate air heating element 106 on and off as a function of a result of sensing such temperature t°.

A further aspect of the method includes sensing a relative humidity Y % of air having been moved over the electronic components 32 and selectively turning the separate air heating element 106 on and off as a function of a result of sensing such relative humidity Y %.

As can be seen, there has been provided an ink jet printer including (a) a frame defining a sheet moving path and a printing zone; (b) copy sheet moving means for moving a supplied copy sheet along the sheet moving path and through the printing zone; (c) a printhead assembly mounted to the frame within the printing zone for printing liquid ink images onto one side of the supplied copy sheet; (d) electronic components including a controller connected to the sheet moving means and to the printhead assembly for controlling operations thereof; and (e) a dual function air cooling and drying system mounted to the frame for moving air to cool the electronic components and to then dry the liquid ink images on the one side of the supplied copy sheet, the dual function air cooling and drying system including conditioning means positioned between the electronic components and the liquid ink images on the supplied copy sheet for selectively varying a condition of air being moved from the electronic components to the liquid images.

While the embodiment disclosed herein is preferred, it will be appreciated from this teaching that various alternative, modifications, variations or improvements therein may be made by those skilled in the art, which are intended to be encompassed by the following claims:

What is claimed is:

1. An ink jet printer comprising:

(a) a frame defining a sheet moving path and a printing zone;

(b) copy sheet moving means for moving a supplied copy sheet along said sheet moving path and through said printing zone;

(c) a printhead assembly mounted to said frame within said printing zone for printing liquid ink images onto one side of said supplied copy sheet;

(d) electronic components including a relative humidity (RH) sensor, and a controller connected to said sheet moving means and to said printhead assembly for controlling operations thereof; and (e) a dual function air cooling and drying system mounted to said frame for moving air to cool said electronic components and to then dry said liquid ink images on said one side of said supplied copy sheet, said dual function air cooling and drying system including conditioning means positioned between said electronic components and said liquid ink images on said supplied copy sheet for selectively varying a condition of air being moved from said electronic components to said liquid images.

2. The ink jet printer of claim 1, wherein said printhead assembly includes at least one thermal ink jet printhead.

3. The ink jet printer of claim 1, wherein said electronic components include a temperature sensor.

4. The ink jet printer of claim 3, wherein said temperature sensor controls the on and off condition of a separate air heating element within said dual function air system.

5. The ink jet printer of claim 1, wherein said controller includes calculating means for calculating liquid ink image area coverage ratio for each image page to be printed by said printhead assembly on said supplied copy sheet.

6. The ink jet printer of claim 5, wherein said dual air system includes a variable speed air moving means having a speed controlled as a function of a result of said liquid ink area coverage calculating means.

7. The ink jet printer of claim 1, wherein said dual function air cooling and drying system includes an air conduit assembly and a variable speed air fan mounted therein for moving a volume of air across said electronic components and variably onto said liquid ink images on said supplied copy sheet.

8. The ink jet printer of claim 7, wherein said air conduit assembly includes a selective air volume divider movable from a fully closed position to a fully open position for regulating a volume of air flowing onto said liquid ink images on said supplied copy sheet.

9. The ink jet printer of claim 7, wherein a selective air volume divider is mounted downstream of said electronic components relative to a direction of air movement.

10. The ink jet printer of claim 1, wherein said conditioning means include a separate air heating element located downstream of said electronic components relative to a direction of air movement for increasing a temperature of air having been drawn over said electronic components.

11. The ink jet printer of claim 1, wherein said conditioning means include a non-uniform air discharge nozzle mounted over said sheet moving path immediately downstream of said printing zone relative to a direction of sheet movement.

12. The ink jet printer of claim 11, wherein said non-uniform air discharge nozzle has a first pattern of narrower and narrower air holes located towards said printhead assembly, a second pattern of larger and larger air holes located farther and farther away downstream of said printhead assembly relative to a direction of sheet movement.

13. The ink jet printer of claim 1, wherein said dual air system includes a variable speed air moving means having a speed controlled as a function of a result of said relative humidity sensor.

14. In a liquid ink jet printer having electronic components and means including a printhead assembly for printing liquid images on a supplied copy sheet, a method of cooling the electronic components and then drying the liquid ink images on one side of the supplied copy sheet, the method comprising:

(a) receiving data into the electronic components about images to be printed with liquid ink;

(b) calculating a liquid ink image coverage ratio for each page of liquid ink images to be printed;

(c) moving air over the electronic components for discharge onto liquid ink images being printed by the printhead assembly on the supplied copy sheet;

(d) selectively varying a condition of air, the air being moved from said electronic components to said liquid images as a function of a result of calculating a liquid ink image coverage ratio for each page of liquid ink images to be printed; and (e) sensing a relative humidity of air having been moved over said electronic components.

15. The method of claim 14, wherein a volume of air being moved from said electronic components to said liquid images is selectively varied as a function of a result of calculating a liquid ink image coverage ratio for each page of liquid ink images to be printed.

16. The method of claim 14, including sensing a temperature of air having been moved over said electronic components and selectively turning a separate air heating element downstream of said electronic components on and off as a function of a result of sensing such temperature.

17. The method of claim 14, including sensing a relative humidity of air having been moved over said electronic components and selectively turning a separate air heating element downstream of said electronic components on and off as a function of a result of sensing such relative humidity.

18. The method of claim 14, including varying a quantity and force of air being discharged onto the liquid ink images by using a non-uniform air discharge nozzle having a first pattern of narrower and narrower air holes located towards the printhead assembly, and a second pattern of larger and larger air holes located farther and farther away downstream of said printhead assembly relative to a direction of sheet movement.

* * * * *